US006224407B1

(12) United States Patent
Duquerroy et al.

(10) Patent No.: US 6,224,407 B1
(45) Date of Patent: May 1, 2001

(54) COAXIAL SWITCH CONNECTOR ASSEMBLY

(75) Inventors: Patrick Duquerroy, Froschhausen (DE); Dieter Bozzer, Bex (CH); Blaise Rithener, Vevey (CH); Lionel Thomas, Bramois (CH)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/284,628

(22) PCT Filed: Dec. 17, 1997

(86) PCT No.: PCT/IB97/01578

§ 371 Date: Jul. 8, 1999

§ 102(e) Date: Jul. 8, 1999

(87) PCT Pub. No.: WO98/31078

PCT Pub. Date: Jul. 16, 1998

(51) Int. Cl.[7] ..... H01R 29/00
(52) U.S. Cl. ..... 439/188
(58) Field of Search ..... 439/188, 247, 439/248, 289, 700, 824, 374

(56) References Cited

U.S. PATENT DOCUMENTS

| | | | | |
|---|---|---|---|---|
| 4,286,335 | * | 8/1981 | Eichler et al. | 455/89 |
| 4,580,862 | | 4/1986 | Johnson | 339/64 R |
| 4,697,859 | * | 10/1987 | Fisher, Jr. | 439/248 X |
| 4,789,357 | * | 12/1988 | Fisher, Jr. et al. | 439/248 |
| 5,167,520 | * | 12/1992 | Henry et al. | 439/266 |
| 5,217,391 | * | 6/1993 | Fisher, Jr. | 439/578 |
| 5,322,453 | * | 6/1994 | Resnick et al. | 439/581 |
| 5,516,303 | | 5/1996 | Yohn et al. | 439/248 |
| 5,611,707 | * | 3/1997 | Meynier | 439/535 |
| 5,625,177 | * | 4/1997 | Yukinori et al. | 200/1 R |
| 5,718,592 | * | 2/1998 | Hosler, Sr. et al. | 439/63 |
| 6,068,499 | * | 5/2000 | Kuriyama et al. | 439/188 |
| 6,142,803 | * | 11/2000 | Bozzer et al. | 439/188 |
| 6,146,168 | * | 11/2000 | Ishii | 439/188 |
| 6,149,448 | * | 11/2000 | Haller et al. | 439/188 |

FOREIGN PATENT DOCUMENTS

| | | | |
|---|---|---|---|
| 0 537 883 A2 | | 4/1993 | (EP) . |
| 685911A1 | * | 5/1995 | (EP) . |
| 0 685 911 A1 | | 12/1995 | (EP) . |
| 2 733 348 A1 | | 10/1996 | (FR) . |
| 2 128 038 | | 4/1984 | (GB) . |

OTHER PUBLICATIONS see PCT International Search Report for any references that are not encolsed herewith.

* cited by examiner

*Primary Examiner*—Gary F. Paumen
*Assistant Examiner*—Phuongchi Nguyen
(74) *Attorney, Agent, or Firm*—Driscoll Nina

(57) ABSTRACT

A coaxial switching connector especially applicable for use in cell phones is provided with a phone connector and a cradle connector where the cradle connector is mounted in a support structure via a conically shaped coil spring that allows both radial and axial displacement of the connector for absorption of tolerances and mechanical solicitation between the cell phone and its cradle.

16 Claims, 4 Drawing Sheets

COAXIAL SWITCH CONNECTOR ASSEMBLY

BACKGROUND OF THE INVENTION

1. Field of the Invention

This invention relates to a coaxial connector assembly.

2. Summary of the Prior Art

A common application for coaxial connectors with a switching function is found in cellular phones. Cell phones comprise their own antennas, but when mounted on a support in an automobile for example, the cell phone connects to an antenna on the automobile. The connection of the cell phone to the automobile antenna requires a switch during plugging of the cell phone to the support. The antenna connector is typically a coaxial type of connector having an inner conductor concentrically surrounded by a ground conductor.

An example of a coaxial switching connector assembly is shown in European Patent Application 0 685 911-A1. The switch function is accomplished by provision of a spring loaded bush mounted concentrically around a coaxial centre pin conductor and biased against a conductor pad. Disconnection between the centre pin and conductor pad occurs during plugging of the complementary connector which depresses the concentric bush member.

One of the problems of the latter design and other coaxial connectors, is that they are not adapted to absorb relatively large tolerances in positioning of the mating parts. This is particularly important in applications such as cell phones, where in comparison to the connector size, the positioning of the cell phone in its support (cradle) may vary significantly.

Another problem arises from the frequent plugging and unplugging and the relatively large shocks and forces to which contacts are subject in applications such as cell phones. It would be desirable to provide a coaxial connector interface that supports high mechanical solicitation and a large number of connection cycles in a compact and cost-effective manner.

SUMMARY OF THE INVENTION

An object of this invention is to provide a coaxial connector assembly that withstands a large number of plugging/unplugging cycles in a reliable manner. It would be advantageous to provide a coaxial connector assembly that can tolerate relatively large tolerances between mating parts. It would be advantageous to provide a coaxial connector assembly with switching function that can withstand many connection/disconnection cycles. It would be further advantageous to provide such connector assemblies in a cost-effective, compact and robust manner.

Objects of this invention have been achieved by providing the coaxial connector assembly according to claim 1. In particular, objects are achieved by provision of a coaxial connector assembly comprising a first coaxial connector and a second coaxial connector pluggably matable therewith in an axial direction, each connector comprising a mating section having an inner contact surrounded by an outer contact and separated therefrom by a dielectric, the outer contact of one of the coaxial connectors having a tapered lead-in portion for guiding and locating the connector mating sections during plugging together, wherein at least one of the connectors comprises a spring resilient in a radial direction orthogonal to the axial direction, the spring positioned intermediate the mating section and a support for fixed attachment to a device such that the connector is resiliently floatable in the radial direction with respect to the device. The spring may further be resilient in the axial direction for axial resilient movement of the connector.

Advantageously therefore, large tolerances between mating parts are absorbed for reliable interconnection over many cycles, and lowering risk of damaging mating components.

Objects of this invention have been achieved by providing the coaxial connector assembly according to claim 12. In particular, objects are achieved by provision of a coaxial connector assembly comprising a first coaxial connector and a second coaxial connector matable therewith in an axial direction, each connector comprising a mating section having an inner contact surrounded by an outer contact and separated therefrom by a dielectric, the first or second coaxial connectors having a tapered funnel shaped lead-in portion for guiding and locating the connector mating sections of the first and second coaxial connectors during plugging together, wherein the inner contact of the first coaxial connector has a pin shape and is resiliently movable in the axial direction.

A further advantageous feature is provision of the axially movable centre contact of the fixed connector that abuts the centre contact of the mobile connector. The latter enhances resistance to shocks and permits reliable connection for many plugging/unplugging cycles. Face to face abutment of centre contacts enables contacts to project only by small amounts from mating faces of the dielectric, thereby reducing the risk of bending or otherwise damaging the centre pin contacts.

Further advantageous aspects of the invention will be apparent from the following description, drawings or claims.

DETAILED DESCRIPTION OF THE PREFERRED EMBODIMENT

Figure 1:
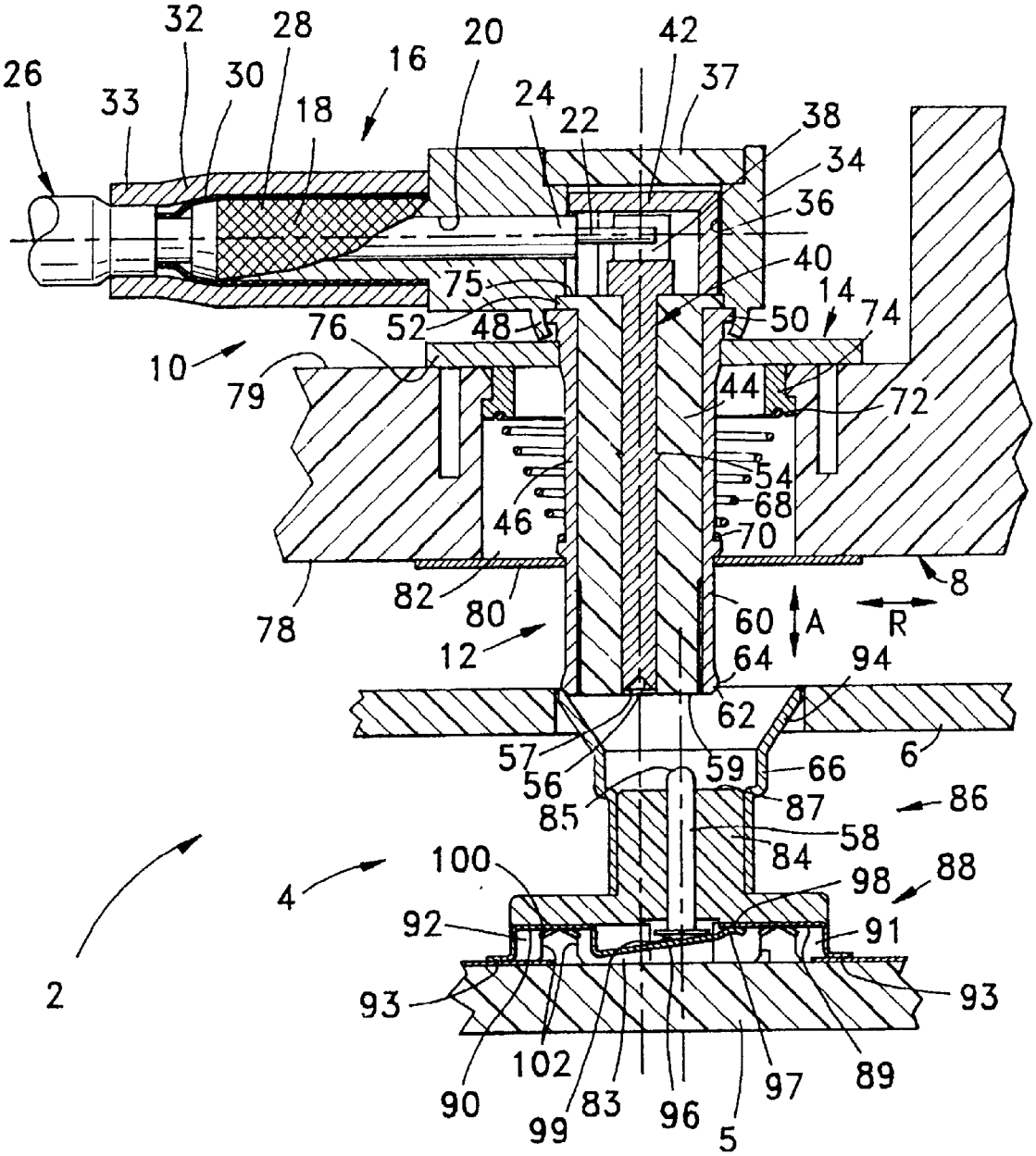
FIG. 1 is a cross-sectional view through a coaxial connector assembly according to this invention in a position just prior to mating.
Figure 2:
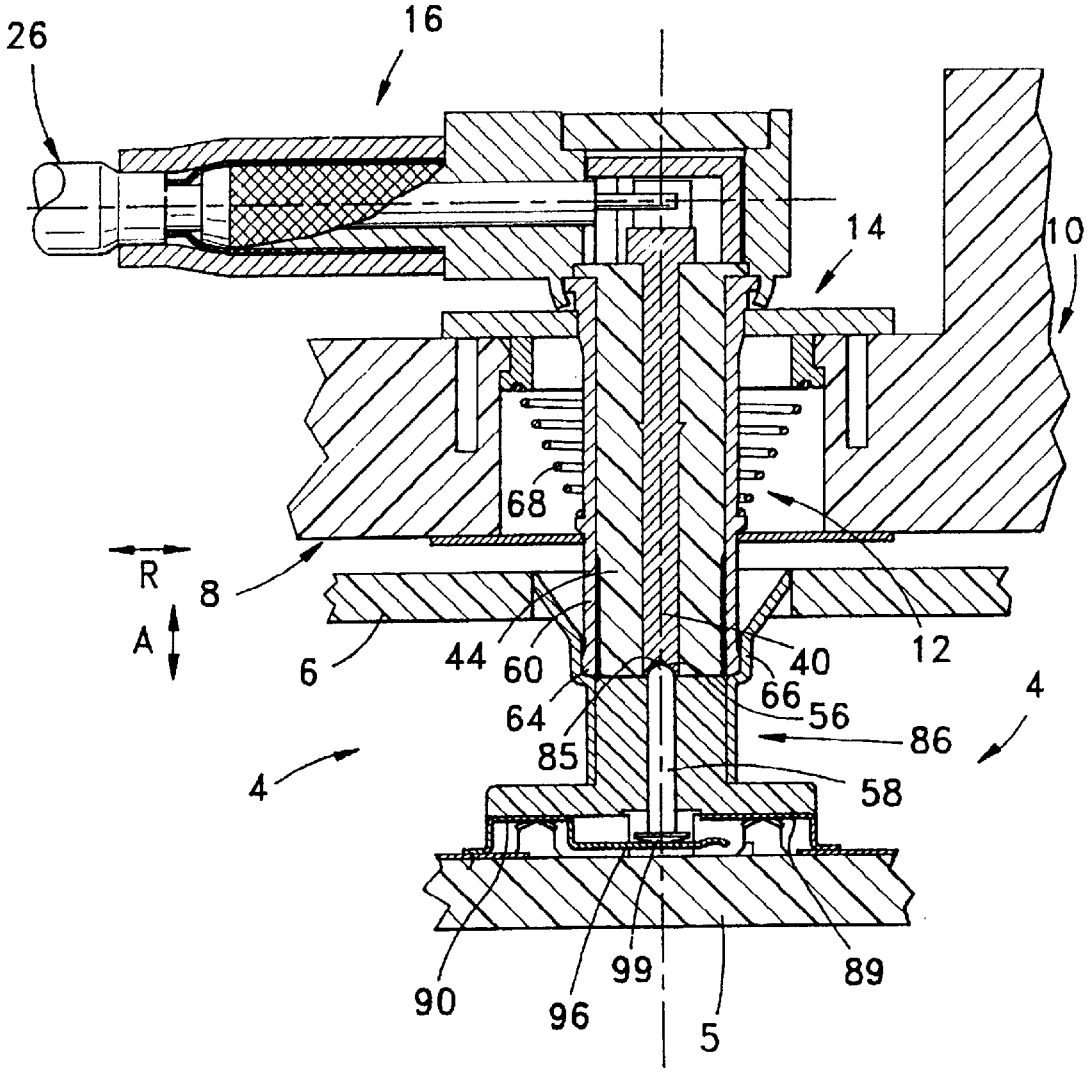
FIG. 2 is a view similar to that of FIG. 1 of the connector assembly in the fully mated position.

Referring to FIGS. 1 and 2, a coaxial connector assembly 2 comprises a first connector 4 mounted on a printed circuit board (PCB) 5 within a device such as a portable phone having an outer housing 6 for reception in a device such as a telephone cradle 8 within which a second connector 10 is mounted for mating with the first connector 4. Hereinafter the first connector 4 will also be called the mobile device connector and the second connector 10 will also be called the fixed device connector.

Referring mainly to FIGS. 1,2,7 and 8, the fixed device connector 10 comprises a mating section 12, a mounting section 14, and a connection section 16. The connection section 16 comprises a tubular portion 18 having a passage 20 for receiving an inner conducting wire 22 surrounded by a dielectric 24 of a coaxial (e.g. antenna) cable 26. The outer surface 28 of the tubular portion 18 is for receiving an outer conductor 30 of the cable 26 thereover. The outer conductor 30 is crimped to the tubular portion by provision of a metallic ring 32 provided therearound, which is plastically deformed during the crimping process. The latter ensures on the one hand good electrical contact between the outer conductor 30 and the connection section, and on the other hand serves as a strain relief for securely holding the cable 26 to the second connector 10. As shown in FIG. 1, a rear portion 33 of the securing ring 32 crimps around the outer insulation of the cable 26. The connection section 16 further comprises a conductive casing 34 integral with the tubular portion 18 and having an axially extending passage 36 orthogonal to the tubular portion and in communication with the inner conductor receiving cavity 20 thereof. The axial passage 36 is provided with an end cap 37 that closes a rear end of the passage once the cable is assembled to the second connector 10. In particular, the open end of the passage 36 enables the cable inner conductor 22 to be soldered, for example to a connection portion 38 of an inner contact 40 of the connector. A dielectric cap 42 can be further provided for positioning over the inner contact connection portion 38 prior to mounting of the cover 37 in order to separate the inner contact 38 from the outer housing and cover 34,37 which perform the function of outer conductor.

The inner contact 40 is mounted within a dielectric 44 which further supports an outer contact 46 concentrically therearound and extending in an axial direction A. The outer contact 46 is electrically and mechanically connected to the connection section outer conductor 34 by means of deformable crimping tabs 48 of the connection section crimped around a shoulder 50 at a connection end of the outer contact 46. The dielectric 44 is provided with a shoulder 52 sandwiched between shoulders of the outer conductor housing 34 and the outer contact 46 for secure attachment thereof.

The inner contact 40 is securely held to the dielectric 44 by means of retention barbs 54 provided therealong in an interference fit with the dielectric 44. A mating end of the substantially cylindrically shaped inner contact 40 is provided with a recess 56, in this embodiment conically shaped. The recess 56 forms a contact surface for receiving and locating a complementary pin contact 58 of the mobile device connector 4 in resilient axial abutment thereagainst. The mating end 57 of the inner contact 40 is slightly recessed with respect to a mating face 59 of the connector, although it is possible to vary the position of the dielectric mating face 59' as best seen when comparing the slightly different embodiments of FIGS. 2 and 7. The latter provides additional protection to the inner contact, and particularly the contact surface 56.

The outer contact 46 is provided with resilient cantilever beam contact arms 60 extending from the mating end 59, their free ends 62 being resiliently inwardly (i.e. radially towards the inner contact 40) biasable. The free ends 62 are provided with contact protrusions 64 for resiliently contacting a concentric outer contact 66 of the mating mobile device connector 4. The resilient cantilever beams 60 are formed by cutting axially extending slits out of the generally tubular shaped outer contact 46.

The mounting section 14 comprises a spring member 68 fixed at one end 70 to the connector mating section 12, and fixed at the other end 72 to a support member 74 securely attached to the device 8, which for example could be the housing of a mobile phone receiving cradle. An axial abutment member 76 is securely attached to the connector mating section 12 proximate the connection end 75 to limit axial displacement of the connector beyond a mating side 78 of the fixed device 8. The abutment member 76 engages a shoulder 79 of the support 8. The spring member 68 is in this embodiment a coil spring having a substantially tapered or conical shape where a small diameter end is wound around and attached to the outer contact 46 at the mating section attachment end 70, and the large diameter end is at the support attachment end 72 in abutment against the support ring 74. The conical shape of the spring enables both axial movement in direction A and radial movement in a plane with a direction R orthogonal to the axial direction A. The connector abutment 76 is thus slidably mounted against the surface 79 of the device 8. The axial biasing force of the spring 68 is slightly greater than the mating force upon full mating of the connectors 4,10, such that the spring is generally only axially compressed once the connectors have been fully mated depending on tolerances. If tolerances between the coupled connectors are such that the spring is axially compressed, the abutment member 76 lifts off the support face 79 of the device 8. The spring may also ac to absorb shacks on the fixed device connector 10, for example if the mobile device housing 6 or other objects abut the connector such that it resiliently moves axially or radially, thereby reducing the risk of damage by such shocks.

As best seen in FIG. 2, the conically shaped coil spring 68 enables substantial radial movement of the fixed device connector 10 with respect to the fixed device 8 in order to absorb tolerances in the radial direction in positioning between the mating connectors 10,4. A flexible bull film or membrane 80 may be provided attached to the outer contact 46 of the mating section 12 in order to cover the cavity 82 of the device 8 within the mating section 12 is received. The latter serves to prevent ingress of dust and the like into the device.

Referring mainly to FIGS. 1–5, the mobile device connector 4 comprises a dielectric housing 84 within which is axially slidably mounted the centre contact 58, and mounted concentrically therearound is an outer contact 66. The connector 4 has a mating section 86 and connection section 88. The connection section 88 comprises a first contact leg 89 and a second contact leg 90 mounted within recesses 91,92 respectively at a PCB mounting end 83 of the dielectric 84. The contact legs 89,90 have surface mount contact portions 93 for surface mount soldering on a PCB 94 for interconnection to electrical components of a mobile phone, for example. The second contact leg 90 comprises a resilient contact arm 96 having a contact protrusion 97 for engagement against a contact surface 98 of the first contact leg 89. The contact arm 96 is prestressed when mounted in the dielectric 84 such that the contact surfaces 97,98 abut with a certain force for reliable electrical contact therebetween. The resilient contact arm 96 extends across and axially below a rounded connection end 99 of the centre pin contact 58. When the pin contact 58 is depressed towards the PCB 5, the contact arm 96 is thus depressed and electrical connection between the legs 89,90 is broken. When the connectors 10,4 are fully mated, abutment of the inner contacts 40,58 thus breaks contact between the contact legs 89,90 as shown in FIG. 2. The latter switch function for example causes a cell phone antenna to be switched to the antenna of the fixed device 8 when the cell phone is mounted thereon. The resilient contact arm also provides the spring force for abutting the slidable inner contact 58 against the mating inner contact 40, such that few components are needed to provide the switching and contact functions. The axial face-to-face abutment of the slidable inner contact 58 and inner contact 40 as shown in FIG. 2, enables the slidable contact end 85 to project only slightly beyond the mating face 87 of the dielectric 84. The latter reduces the risk of damage to the contacts during plugging, or with respect to external objects.

The outer contact 66 is provided with a large conical lead-in section 94 for guiding the mating section 12 during plugging. The tapered or conical lead-in section 94 is quite substantial in order to absorb relatively large tolerances in radial positioning of the connectors 4, 10.

Figure 6:
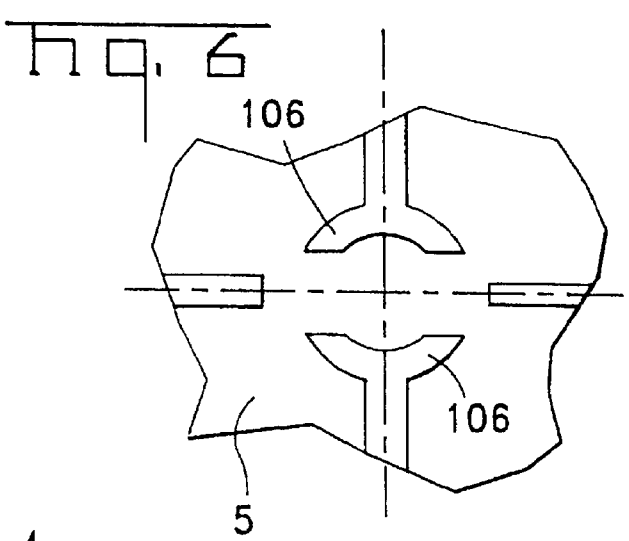
FIG. 6 is a detailed plan view of part of a printed circuit board on which the connector of FIGS. 3–5 is received.
Figure 3:
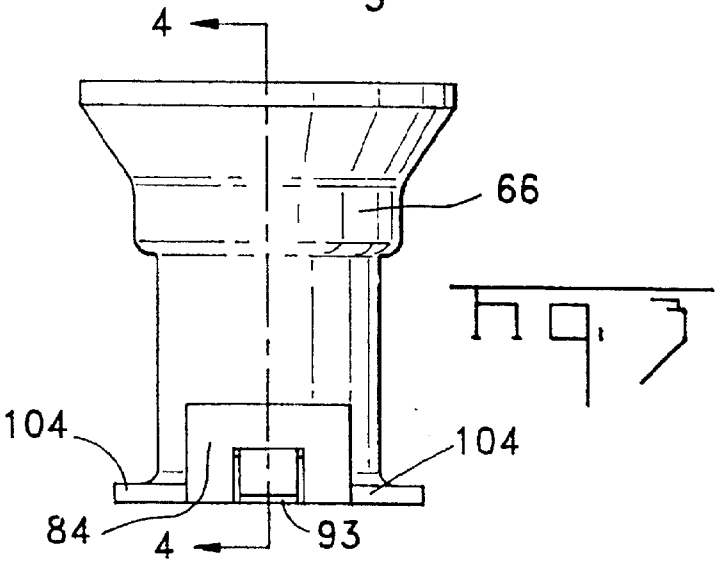
FIG. 3 is a side plan view of a fixed connector of the connector assembly.
Figure 5:
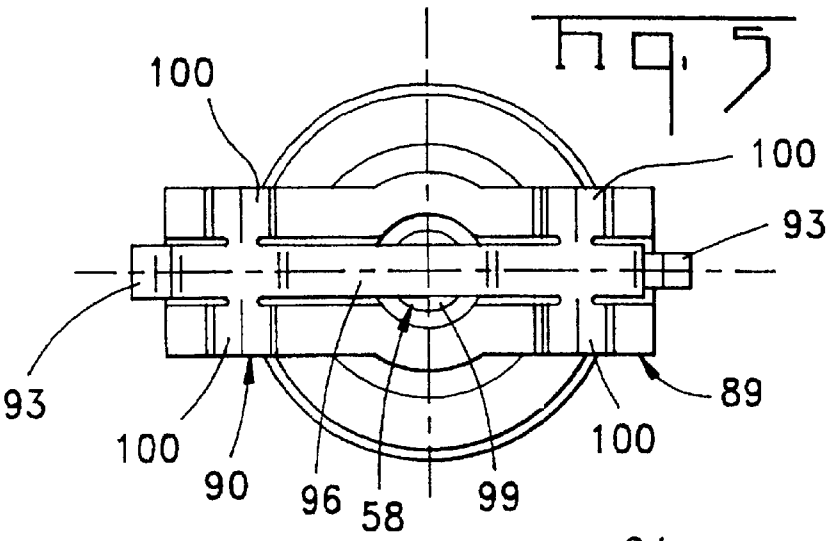
FIG. 5 is a view in the direction of arrow 5 of FIG. 4.
Figure 4:
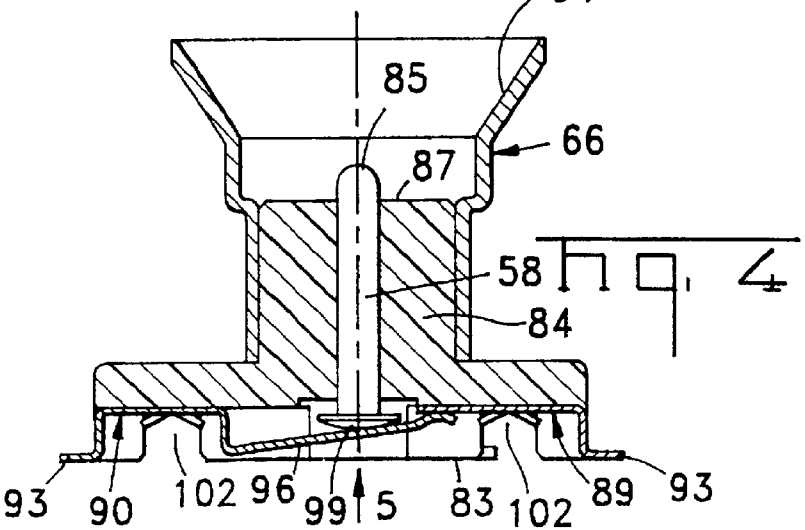
FIG. 4 is a cross-sectional view through lines 4—4 of FIG. 3.
Figures 7, 8:
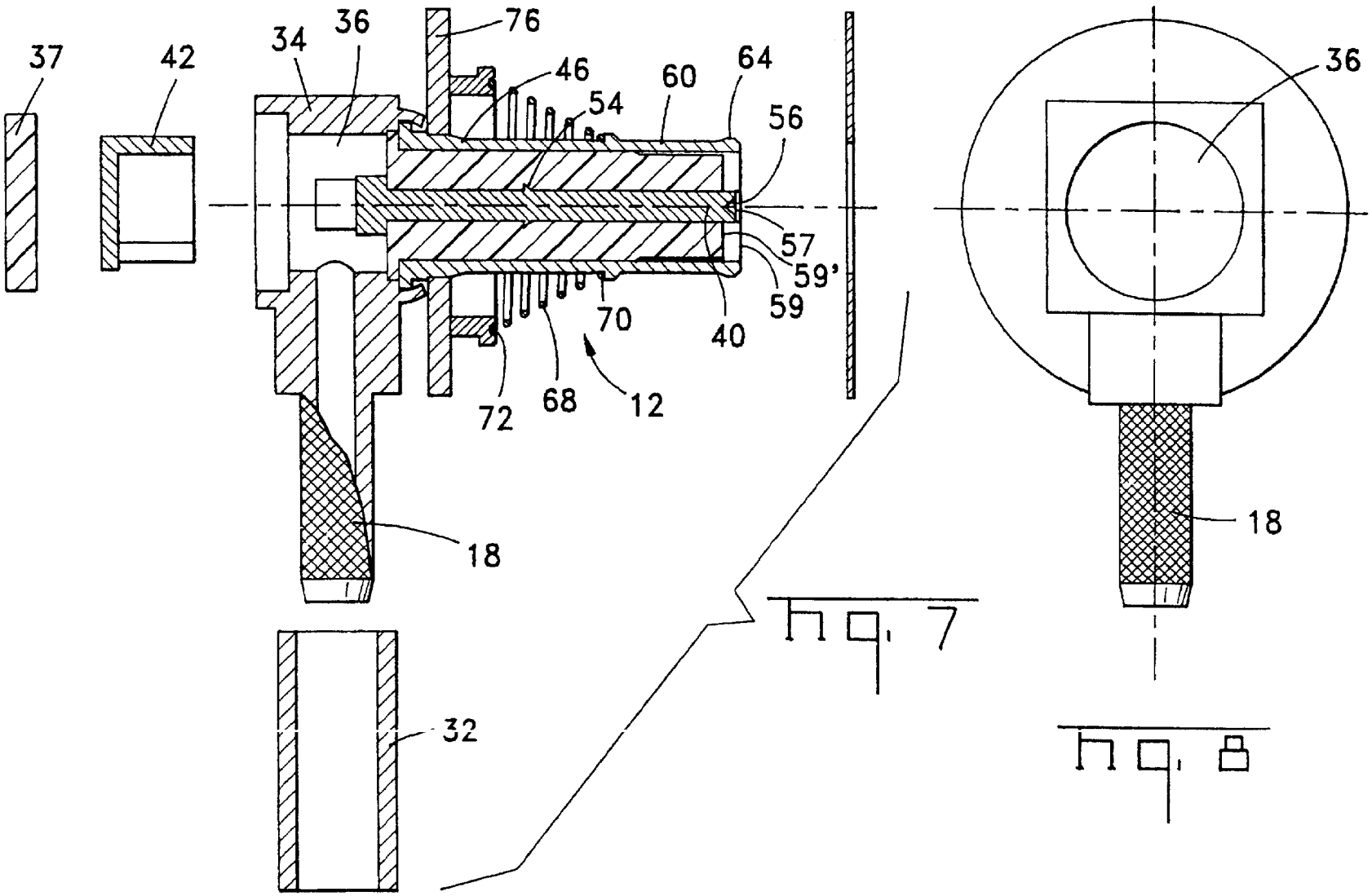
FIG. 7 is an exploded cross-sectional view through a mobile connector of the connector assembly of FIGS. 1 and 2.
FIG. 8 is a plan end view of part of the connector of FIG. 7.

The contacts legs 89,90, which may be cost effectively manufactured from stamping and forming sheet metal, are provided with V-shaped retention members 100 that dig into opposed walls of a slot 102 in the mounting end 93 of the dielectric 84. The contact legs can thus be securely attached and positioned with respect to the dielectric 84 by merely depressing the retention portions 100 into the slot 102. The connector 4 maybe robustly supported on the PCB by the solder connection of the contact legs 93 in addition the solder connection of the outer contact 66 which is provided with opposed solder mount extensions 104 mountable against the PCB 5. As shown in FIG. 6, the PCB 5 is provided with arcuate conductive traces 106 for solder connection to the outer contact solder mount extensions 104. Due to the arcuate shape of the extensions 104, which are substantially a continuation of the cylindrical shape of the outer contact 66, a robust attachment to the PCB is provided, in addition to the possibility of providing a substantial solder area around the connector 4 that enhances the robustance of the solder connection. The solder connections also provide the electrical connections to the outer and inner contacts 66,58.

What is claimed is:

1. A coaxial connector assembly comprising a first coaxial connector and a second coaxial connector matable therewith in an axial direction, each connector comprising a mating section having an inner contact surrounded by an outer contact and separated therefrom by a dielectric, the first coaxial connector having a tapered funnel shaped lead-in portion for guiding and locating the connector mating sections of the first and second coaxial connectors during plugging together, wherein the inner contact of the first coaxial connector is substantially pin shaped and is resiliently movable in the axial direction with respect to the outer contact of the first coaxial connector, where the first coaxial connector further includes first and second contact legs, at least one of which comprises a resiliently supported contact for engaging a contact of the other leg when the connectors are unmated, the resiliently supported contact engaged by the inner contact of the first coaxial connector when the inner contact is axially depressed during mating of the coaxial connectors.

2. The connector assembly of claim 1 wherein the mating section of the second coaxial connector is resiliently floatably mounted to a support of a device.

3. The connector assembly of claim 1 wherein the funnel shaped lead-in portion on the first coaxial connector extends beyond a mating face of the first connector dielectric, and wherein the pin-shaped centre contact of the first coaxial connector has a contact end projecting beyond the dielectric mating face and still within the lead-in portion.

4. The connector assembly of claim 1 wherein the contact legs of the first coaxial connector each have surface mount contact pads, positioned at opposed ends of the connector, for soldering on a PCB.

5. The connector assembly of claim 1 wherein the first coaxial connector outer contact comprises extensions on opposed sides of the dielectric for mounting on a PCB, the extensions having a curved shape in axial continuation of a substantially cylindrical mating section of the outer contact such that the solder pads arranged at ends of the extensions have substantially arcuate shapes.

6. The connector assembly of claim 1 wherein the inner contact of the second coaxial connector has a concave contact surface that is fixed in position relative to the surrounding dielectric.

7. The connector assembly of claim 6 wherein concave the contact surface of the inner contact of the second coaxial connector is substantially conical in shape.

8. A coaxial connector assembly of claim 1 wherein at least the second coaxial connector comprises a spring that is resilient in a radial direction orthogonal to the axial direction, the spring positioned intermediate the mating section and a support for fixed attachment to a device within which the second coaxial connector is mounted, such that the second coaxial connector is resiliently floatable in the radial direction with respect to the device.

9. The connector assembly of claim 8 wherein the spring is also resilient in the axial direction, whereby the spring force is greater than a mating force required for fully mating the coaxial connectors.

10. The connector assembly of claim 9 wherein the spring is a substantially conically shaped coil-spring, engaging at a small diameter end the mating section of the second coaxial connector, and at a large diameter end the support.

11. A coaxial connector for mating with a complementary coaxial connector, comprising:

an outer contact having an inner portion including a tapered funnel shaped lead-in portion for guiding and locating a mating portion of the complementary coaxial connector and a contact portion for establishing electrical contact with an outer contact of the mating portion of the complementary coaxial connector, where the outer contact also includes a mount for attachment to a substrate;

a dielectric housing fitted to the outer contact and extending therein to a face located below the lead in portion and having an axially extending passageway therethrough;

a pin shaped inner contact located within the passageway and being axially displaceable therein, the inner contact having a contact end for engagement with an inner contact of the mating end of the complementary coaxial connector upon mating therewith, the contact end of the inner contact extending beyond the face of the dielectric housing and below the lead-in portion of the outer contact; and, a first contact leg and a second contact leg where each contact leg includes a contact surface and a contact portion for engaging the substrate, at least one of the contact legs being resilient, the contacts being positioned such that when the coaxial connector and the complementary coaxial connector are unmated the resiliency of the one contact leg biases the contact surfaces of the two contact legs into engagement and biases the contact end of the pin shaped inner contact from the face of the dielectric housing, the pin shaped inner contact being displacable against the resiliency of the resilient contact leg such that the contact surfaces disengage.

12. The coaxial connector of claim 11, wherein the contact end of the inner contact is configured for butting engagement with the inner contact of the mating coaxial connector.

13. The coaxial connector of claim 11, wherein the pin shaped inner contact is positioned along the resilient contact leg between the contact surface and the contact portion.

14. The coaxial connector of claim 13, wherein the pin shaped inner contact and the resilient contact leg are separate members.

15. The coaxial connector of claim 11, wherein the contact portions of the contact legs and the mount of the outer contact are adapted for surface mount soldering for attachment upon the substrate.

16. The coaxial connector of claim 15, wherein the contact portions of the contact legs and the mount of the outer contact are co-planar.

* * * * *